US008734639B2

(12) United States Patent
Siskin et al.

(10) Patent No.: US 8,734,639 B2
(45) Date of Patent: May 27, 2014

(54) UPGRADING OF PETROLEUM RESID, BITUMEN OR HEAVY OILS BY THE SEPARATION OF ASPHALTENES AND/OR RESINS THEREFROM USING IONIC LIQUIDS

(75) Inventors: Michael Siskin, Randolph, NJ (US); Manuel A. Francisco, Phillipsburg, NJ (US); Rustom M. Billimoria, Hellertown, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 730 days.

(21) Appl. No.: 12/080,179

(22) Filed: Apr. 1, 2008

(65) Prior Publication Data

US 2008/0245705 A1 Oct. 9, 2008

Related U.S. Application Data

(60) Provisional application No. 60/922,164, filed on Apr. 6, 2007.

(51) Int. Cl.
*C10G 29/20* (2006.01)

(52) U.S. Cl.
USPC ..... 208/309; 208/177; 208/236; 208/208 R; 208/289; 208/311; 208/330

(58) Field of Classification Search
USPC ..... 208/86, 309, 177, 236, 208 R, 289, 311, 208/330
See application file for complete search history.

(56) References Cited

U.S. PATENT DOCUMENTS

| | | | | |
|---|---|---|---|---|
| 5,948,242 | A * | 9/1999 | Ohsol et al. | 208/181 |
| 2003/0085156 | A1 * | 5/2003 | Schoonover | 208/230 |
| 2004/0045874 | A1 * | 3/2004 | Olivier-Bourbigou et al. | 208/238 |
| 2006/0070919 | A1 | 4/2006 | Vallee et al. | |

OTHER PUBLICATIONS

Liu, Y. et al., "Ionic Liquids: Novel Solvents for Petroleum Asphaltenes", Chinese J. Eng., (2005), pp. 564-567, vol. 13.

* cited by examiner

*Primary Examiner* — Prem C Singh
*Assistant Examiner* — Michelle Stein
(74) *Attorney, Agent, or Firm* — Bruce M. Bordelon; Chad A. Guice

(57) ABSTRACT

Petroleum resid, bitumen and/or heavy oil is upgraded by the separation of asphaltenes and/or resins from such resids, bitumen and/or heavy oils by contacting them with an ionic liquid with which the asphaltenes and/or resins interact.

9 Claims, No Drawings

UPGRADING OF PETROLEUM RESID, BITUMEN OR HEAVY OILS BY THE SEPARATION OF ASPHALTENES AND/OR RESINS THEREFROM USING IONIC LIQUIDS

This application claims the benefit of U.S. Provisional Application No. 60/922,164 filed Apr. 3, 2007.

BACKGROUND OF THE INVENTION

1. Field of the Invention

The present invention relates to the upgrading of petroleum residium (petroleum resid), bitumen and/or heavy oils by the removal therefrom of heavy, high molecular weight multi-ring aromatics and metals present in such petroleum resid, bitumen, shale oil and/or heavy oils in the form of asphaltenes and/or heavy resins and/or polycyclic hetero (N) aromatics.

2. Description of the Related Art

Heavy, high molecular weight multi-ring aromatics, polycyclic hetero (N,S,O) aromatics and metals-containing molecules, e.g., porphyrins, are present in petroleum resid, bitumen and/or heavy oils largely in the form of a solubility class called asphaltenes or, depending on the feed, as individually identifiable molecular types, e.g., the asphaltene can comprise a mixture of such materials, or materials such as polycyclic hetero atom(N,S,O)-containing aromatics can be present per se, in such feeds.

The asphaltene fraction present in such feeds contains the most polar molecules. Traditionally, to force such asphaltene materials out of the petroleum resid, bitumen and/or heavy oils, a process known as solvent deasphalting is practiced. In that process, an excess of non-polar solvent is added to the petroleum resid, bitumen and/or heavy oils (hereinafter collectively referred to as heavy hydrocarbon feed stream) to force the polar asphaltene material out of the heavy hydrocarbon feed stream. Current commercial deasphalting processes use liquid propane or liquid butane as the non-polar precipitation inducing solvent. Such processes are energy intensive requiring the refrigeration and compression/pressurization of the propane or butane to condense them into a liquid. Following the removal of the precipitated asphaltene from the now deasphalted heavy hydrocarbon feed stream containing the liquid propane or butane, the propane or butane is recovered by evaporation from the heavy hydrocarbon feed stream, necessitating the re-refrigeration and re-pressurization of the now gaseous propane or butane for re-condensation into liquid form for re-use. Another drawback of solvent deasphalting, in addition to the high energy costs involved, is the lack of selectivity in the solvent deasphalting process. The lack of selectivity of the solvents is evidenced by the co-precipitation of non-asphaltenic molecules along with the asphaltenes and the presence of residual asphaltene molecules in the deasphalted oil (DAO) fraction.

Alternatively, petroleum resid can be visbroken, coked or used as residual sulfur fuel oil (RSFO) or as asphalt without removal of the asphaltene fraction. Such processes are also either energy intensive, expensive or wasteful of high value hydrocarbons present in the petroleum resid feed stream.

More desirable, however, are processes such as the solvent deasphalting previously described, which, following removal of the asphaltene fraction, produce a deasphalted oil (DAO) which has a higher value and is of higher quality residual sulfur fuel oil (RSFO) or as feedstock for fluid catalytic cracking (FCC) to force higher value liquids which could not be otherwise secured from the petroleum resid per se. The recovered asphaltene fraction is currently processed via high temperature thermal chemistry (coking and/or visbreaking) to form slightly higher value liquids and coke, or it is used as feedstock for asphalt production.

It would be highly desirable to develop a process for the removal of the heavy, high molecular weight multi-ring aromatics and/or resins and/or polycyclic hetero atom(N,S,O)-containing aromatics (hereinafter collectively referred to as asphaltenes unless otherwise indicated) from petroleum resid, bitumen and/or heavy oils, which is less energy intensive, e.g., uses little or no solvent, and is more selective.

DESCRIPTION OF THE INVENTION

Heavy, high molecular weight multi-ring aromatics, and/or resins, and/or polycyclic hetero atom(S,N,O)-containing aromatics are separated from heavy hydrocarbon feed streams comprising petroleum resid and/or bitumen, and/or shale oil, and/or heavy oils by the process of contacting such heavy hydrocarbon feed streams with an ionic liquid. The ionic liquid interacts with the high molecular weight multi-ring aromatics, and/or resins, and/or polycyclic hetero atom(S,N,O)-containing aromatics (referred to collectively as asphaltenes) which are soluble in such ionic liquids thereby separating and removing them from the remainder of the heavy hydrocarbon feed stream which are not soluble in or interact with the ionic liquids. The ionic liquid now saturated with the soluble high molecular weight multi-ring aromatics, and/or resins, and/or polycyclic hetero atom(S,N,O)-containing aromatics is separated from the remainder of the now deasphalted heavy hydrocarbon feed stream. Such separation can take the form of decantation due to the phase differences between the saturated ionic liquid and the insoluble deasphalted heavy hydrocarbon feed stream remainder, or any other such separation process selected by the practitioner.

The recovered saturated ionic liquid can be reconstituted/recovered by springing the high molecular weight multi-ring aromatics, and/or resins, and/or polycyclic hetero atom(S,N,O)-containing aromatics by the addition of a replacing more polar, low boiling solvent such as water or low molecular weight alcohol such as methanol or ethanol which displaces and replaces the high molecular weight multi-ring aromatics, and/or resins, and/or polycyclic hetero atom(S,N,O)-containing aromatics associated with the ionic liquid. The ionic liquid now associated with/saturated with the replacing polar solvent can be recovered by distillation which drives off the replacing polar solvent resulting in recovered ionic liquid suitable for re-use and a recovered replacing polar solvent.

Alternatively, the ionic liquid can be separated and recovered from the high molecular weight multi-ring aromatics, and/or resins, and/or polycyclic hetero atom(S,N,O)-containing aromatics with which it is saturated by vacuum distilling the saturated ionic liquid at a temperature below the decomposition temperature of the ionic liquid, thereby recovering the ionic liquid as overhead, leaving the high molecular weight multi-ring aromatics, and/or resins, and/or polycyclic hetero atom(S,N,O)-containing aromatics behind as residue which can be recovered and subjected to further processing as desired by the practitioner.

The process described above would use none, if any, of the more difficult to recover and reuse solvents such as propane or butane. If any solvent is used it is the replacing polar solvent such as water or low boiling alcohol, e.g., methanol, or ethanol which can be recovered/separated from the ionic liquid by distillation at low temperatures.

The present process is preferably conducted under liquid/liquid contacting conditions, that is both the ionic liquid and the heavy hydrocarbon feed stream are in the flowable liquid form. The ionic liquid and the heavy hydrocarbon feed stream can be contacted at a temperature in the range of about 60 to 225° C., the upper limit of the temperature being below the decomposition temperature of the ionic liquid. If not already in the flowable liquid form at ambient conditions, the heavy hydrocarbon feed stream can be heated to make it a flowable liquid and to reduce its viscosity so as to facilitate its thorough contacting and mixing with the ionic liquid. Heating the heavy hydrocarbon feed stream to a temperature of about 50 to 225° C., preferably about 100 to 175° C., more preferably about 100 to 165° C. should be sufficient to ensure that the heavy hydrocarbon feed stream is in a sufficiently flowable liquid form so as to be capable of thorough mixing and contacting with the ionic liquid.

Alternatively, an aromatic diluent such as toluene, xylene, or a naphtha can be added to solvate the heavy hydrocarbon feed stream to reduce viscosity (i.e., make it a flowable liquid) and/or facilitate mixing and contacting with the ionic liquid. In another embodiment, both heating and an aromatic or aromatic-containing diluent can be employed.

An ionic liquid is a liquid organic salt consisting 100% of ions, which exhibits no measurable vapor pressure below its thermal decomposition temperature. Ionic liquids usually have melting points below about 150° C. Ionic liquids suitable for use in the present process exclude those that exist only in the form of aqueous solutions, such as ammonium hydroxide.

Ionic liquids include organic salts wherein suitable cations include:

$R^1{}_4N^+$; $R^1{}_4P^+$ wherein $R^1$ is $C_1$ to $C_8$ hydrocarbyl, preferably alkyl;

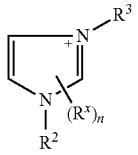

wherein $R^2$ is $C_1$-$C_{10}$ hydrocarbyl, preferably alkyl, and $R^3$ is $C_1$ to $C_{10}$ hydrocarbyl, more preferably $R^2$ is —$CH_3$, $R^3$ is —$C_2H_5$, $R^x$ is H or $C_1$ to $C_{12}$ hydrocarbyl, preferably H or $C_1$-$C_6$ hydrocarbyl and n is the number of available carbons in the ring;

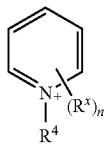

wherein $R^4$ is $C_1$-$C_{10}$, hydrocarbyl, preferably alkyl, more preferably —$CH_3$ or —$C_2H_5$, and wherein $R^x$ is H or $C_1$-$C_{12}$ hydrocarbyl, preferably H or $C_1$ to $C_6$ hydrocarbyl, and n is the number of available carbons in the ring;

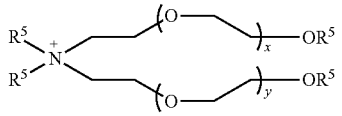

or

-continued

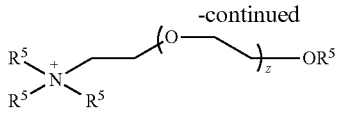

wherein the $R^5$s are the same or different and are H or $C_1$-$C_{10}$ alkyl, $C_1$-$C_{10}$ hydroxyl alkyl, $C_6$-$C_{10}$ aryl, $C_7$-$C_{10}$ aryl alkyl, $C_7$-$C_{10}$ alkyl aryl, preferably H or $C_1$-$C_{10}$ alkyl and $C_1$-$C_{10}$ hydroxy alkyl, and x, y and z are integers ranging from about 1 to 30, preferably about 1 to 10.

Electron withdrawing groups on the carbon of the aromatic rings of the above cation tend to destabilize the ionic liquids when the anions are organic anions.

The above recited cations are preferred.

Suitable Anions Include:

halides, $HSO_4^-$, $H_2PO_4^-$, $RCOO^-$, $NO_3^-$, $BX_4^-$, $PX_6^-$, $Al_2X_7^-$, $Ga_2X_7^-$, $SO_4^{-2}$, $PO_4^{-3}$, $RSO_3^-$, $ROSO_3^-$, $RPO_3^{-2}$,

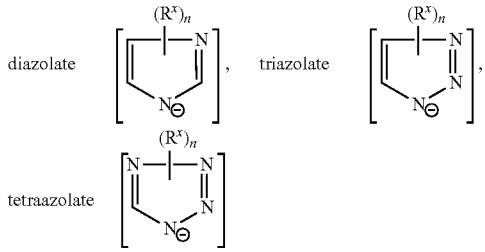

wherein $R^x$ and n are as previously defined and X is halogen.

Electron withdrawing groups on the carbon positions of such heterocyclic anions stabilize the resulting ionic liquids and would be desirable.

Electron withdrawing groups are those that draw electrons away from the aromatic ring and include groups such as —$NH_3^+$, —$NO_2$, —$SO_3H$, —COOH, -halogen.

Complex anions such as $BF_4^-$ and $PF_6^-$ while expected to be operable in the present process are not desirable because in the presence of water, which might be present in the heavy hydrocarbon feed stream, they would give off HF. Even if the heavy hydrocarbon feed stream can be kept free of water, the recovery of the ionic liquid once saturated could not utilize the low molecular weight alcohol, preferably methanol or ethanol, or water springing method which would be the preferred ionic liquid recovery method, but would require vacuum distillation.

Anions such as $RSO_3^-$ and $ROSO_3^-$ are water soluble and thus would not be easily recoverable by displacement using water or alcohol but would require vacuum distillation.

$Al_2Cl_7^-$ $Ga_2Cl_7^-$ give rise to an acidic ionic liquid which could be useful in the present process, but it is sensitive to excess water so care must be taken to remove the water from heavy hydrocarbon feed streams. It also prohibits the use of water springing to recover the ionic liquid for re-use.

One of the benefits, however, of using a reactive ionic liquid such as an acidic ionic liquid (e.g., anion$^+$+$Al_2Cl_7^-$) is the possibility that when the reactive ionic liquid interacts with the heavy high molecular weight multi-ring aromatic, and/or resin, and/or polycyclic hetero atom(S,N,O)-containing aromatic, to extract it/them from the heavy hydrocarbon feed stream, the reactive ionic liquid can cleave any $C_3^+$ alkyl groups on the heavy high molecular weight multi-ring aromatics, and/or resins, and/or polycyclic hetero atom(S,N,O)-containing aromatics by an acid catalyzed mechanism to generate an olefin and a methylated aromatic moiety, with subsequent release/expulsion of the olefin back into the heavy hydrocarbon feed stream. If conducted in the presence of hydrogen, the olefin could be hydrogenated into a paraffin which will be released/expelled by the ionic liquid back into the heavy hydrocarbon feed stream. In such a system the saturated reactive ionic liquid would be regenerated/recovered by distillation under vacuum. A benefit of such a system would be the recovery of a $C_2^+$ alkyl or alklenyl group and the addition of such olefin or paraffin back to the heavy hydrocarbon feed stream, thus increasing yield.

The reactivity of ionic liquids can be enhanced by the dissolution in the ionic liquid of a metal salt, e.g., iron halides, copper halides, zinc halides, mercury halides, tin halides, manganese halides.

In practicing the present invention the heavy hydrocarbon feed stream and the ionic liquid will need to be intimately mixed and contacted. In such a system at least one and preferably both of the heavy hydrocarbon feed stream and the ionic liquid are in the flowable liquid state.

The ionic liquid, however, is preferably used in the liquid state, that is, at a temperature above its melting point but below its thermal decomposition temperature, preferably above its melting point but below about 300° C., more preferably above its melting point but below about 250° C., most preferably above its melting point but below about 200° C.

The heavy hydrocarbon feed stream is used in a flowable liquid state. This can be achieved by heating to a temperature between about 50 to 225° C., preferably about 100 to 175° C., more preferably about 100 to 165° C. If the temperature to which the heavy hydrocarbon feed stream must be heated to become a flowable liquid is above the thermal decomposition temperature of a particular ionic liquid, then a different ionic liquid having a higher thermal decomposition temperature would have to be used, or a diluent such as a light aromatic solvent, e.g., toluene, xylene or naphtha may be used in place of heating to reduce the viscosity of the heavy hydrocarbon feed stream making it amenable to intimate mixing and contacting with the ionic liquid.

The heavy hydrocarbon feed stream and the ionic liquid can be mixed in an about 1:1 ratio on a volume basic, preferably above 5:1 to 1:1 volumes of heavy hydrocarbon feed stream to ionic liquid, more preferably the smallest amount of ionic liquid is employed, i.e., an amount of ionic liquid at least equal to the amount of heavy high molecular weight multi-ring aromatics, and/or resins, and/or polycyclic hetero atom (S,N,O)-containing aromatics present in the heavy hydrocarbon feed stream is used.

Contacting time/interaction time depends, of course, on how complete and thorough the mixing is between the heavy hydrocarbon feed stream and the ionic fluid. When the mixing is vigorous and thorough, achieving intimate interaction/contact between the heavy hydrocarbon feed stream and the ionic liquid, contact time of about 60 minutes or less, preferably about 30 minutes or less, more preferably about 10 minutes or less should be sufficient, the minimum time employed, however, being that which provides removal of the heavy high molecular weight multi-ring aromatics, and/or resins, and/or polycyclic hetero atom(S,N,O)-containing aromatics from the heavy hydrocarbon feed stream.

The heavy hydrocarbon feed stream is, as previously indicated, a petroleum resid, bitumen or heavy oil.

Petroleum resid is a high boiling fraction recovered from crude distillation at 900-1050° F., preferably 900-1030° F., more preferably 980-1030° F. at atmospheric pressure or at the vacuum distillation temperature equivalent thereof.

Petroleum resid is commonly made-up of asphaltenes, which are heavy, high molecular weight (~1500 Mn) polar aromatic molecules which also contain metals; other polar molecules such as resins contain minimal metals but which do contain sulfur and nitrogen are smaller than asphaltenes; other polycyclic aromatics; naphthalene aromatics; naphthalenes; and paraffins. Resins are lower molecular weight versions of asphaltenes. The resins act as surfactant "like" molecules, stabilizing and dispersing the polar asphaltenes in the relatively less polar hydrocarbon matrix which is the bulk of petroleum crude oil, resides and bitumens.

In the present specification "bitumen" means the heavy oil recovered from tar sands while "heavy oils" include resids, heavy Venezuelan, Russian, Brazilian, arctic etc. oils not necessarily associated with sands, but which have greater than about 20% boiling above 1000° F.

In addition to removing asphaltenes per se from petroleum resid, bitumen and/or heavy oils, materials such as higher molecular weight nitrogen containing heterocyclic aromatic ring systems such as the carbazole and indole moiety-containing molecules should be removable from heavy oil and other oil streams such as from a vacuum gas oil (VGO) or shale oil derived feeds by contacting with the ionic liquids.

The value of the high solubility parameter ionic liquid interaction with the high solubility parameter asphaltenes in petroleum resid, and/or bitumen, and/or heavy oil is because in the petroleum resid, and/or bitumen and/or heavy oil the polar ionic liquid interaction is selective with respect to the larger polar asphaltene molecules present in the heavy hydrocarbon feed stream. The asphaltenes in the heavy hydrocarbon feed stream react much more readily and completely than do the lighter, smaller polycyclic aromatics in the heavy hydrocarbon feed stream. This selectivity in a mixed polycyclic aromatics-containing stream is crucial for the process to be viable. Selective separation of the asphaltenes from the feed with the substantial exclusion of the lighter, smaller polycyclic aromatics would result in the recovery of an asphaltene suitable for the production of higher grade asphalt as a consequence of its lower light aromatic content, and in the recovery of a deasphalted oil (DAO) containing more of the more valuable light polycyclic aromatics which makes the DAO such a valuable feed for upgrading in, e.g., fluid catalytic cracking and hydrotreating.

What is claimed is:

1. A process for the removal of heavy, high molecular weight multi-ring aromatics, and/or resins, and/or polycyclic hetero atom(S,N,O)-containing aromatics from heavy hydrocarbon feed streams comprising petroleum resid, and/or bitumen, and/or shale oil, and/or heavy oils by contacting such heavy hydrocarbon feed streams with an ionic liquid which interacts with and in which the high molecular weight multi-ring aromatics, and/or resins and/or polycyclic hetero atom (S,N,O)-containing aromatics, are soluble, and separating said ionic liquid saturated with the heavy, high molecular weight multi-ring aromatics, and/or resins, and/or polycyclic hetero atom(S,N,O)-containing aromatics from the remainder of the heavy hydrocarbon feed stream;

wherein the ionic liquid is an organic salt wherein the cation is selected from

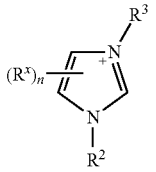

wherein $R^2$ is $C_1$-$C_{10}$ hydrocarbyl, $R^3$ is $C_1$ to $C_{10}$ hydrocarbyl, $R^x$ is H or $C_1$ to $C_{12}$ hydrocarbyl, and n is the number of available carbons in the ring;

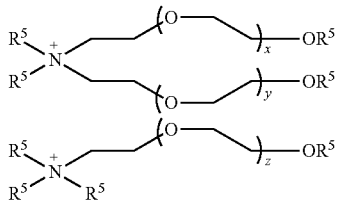

or wherein $R^5$s are the same or different and selected from hydrogen, $C_1$-$C_{10}$ alkyl, $C_1$-$C_{10}$ hydroxy alkyl, $C_6$-$C_{10}$ aryl, $C_7$-$C_{10}$ arylalkyl, $C_7$-$C_{10}$ alkyl aryl, and x, y and z are integers ranging from about 1 to 30;

and the anion is selected from $RCOO^-$,

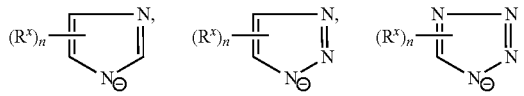

or $RPO_3^{-2}$, wherein $R^x$ and n are as previously defined.

2. The process of claim 1 wherein the ionic liquid has a melting point below about 150° C.

3. The process of claim 1 wherein the ionic liquid saturated with the heavy, high molecular weight multi-ring aromatics, and/or resins, and/or polycyclic hetero atom(S,N,O)-containing aromatic is recovered for reuse by contacting the saturated ionic liquid with a replacing polar solvent which is more polar than the heavy, high molecular weight multi-ring aromatics, and/or resins, and or polycyclic hetero atom(S,N,O)-containing aromatics, thereby displacing them from the ionic liquid, the ionic liquid now saturated with the replacing polar solvent being separated from the heavy, high molecular weight multi-ring aromatics, and/or resins, and/or polycyclic hetero atom (S,N,O)-containing aromatics, the separated ionic liquid being recovered by distillation to drive off the replacing polar solvent.

4. The process of claim 1 wherein the separated saturated ionic liquid is recovered by distillation under vacuum at a temperature below the decomposition temperature of the ionic liquid, the ionic liquid being recovered as overhead.

5. The process of claim 1 wherein the ionic liquid and the heavy hydrocarbon feed stream are contacted in the liquid state at a temperature in the range of about 60 to 225° C.

6. The process of claim 1 wherein the ionic liquid and the heavy hydrocarbon feed stream are contacted in the presence of an aromatic diluent.

7. The process of claim 1 wherein the ionic liquid is not in the form of an aqueous solution.

8. The process of claim 1 wherein the heavy hydrocarbon feed stream and the ionic liquid are mixed in an about 1:1 volume ratio.

9. The process of claim 1 wherein the heavy hydrocarbon feed stream and the ionic liquid are mixed in a ratio of about 5:1 to 1:1 on a volume basis.

* * * * *